US008341907B1

(12) United States Patent
Gourley

(10) Patent No.: US 8,341,907 B1
(45) Date of Patent: Jan. 1, 2013

(54) STRUCTURALLY REINFORCED MODULAR BUILDINGS

(76) Inventor: Mervin D. Gourley, North Hills, CA (US)

( * ) Notice: Subject to any disclaimer, the term of this patent is extended or adjusted under 35 U.S.C. 154(b) by 0 days.

(21) Appl. No.: 13/506,288

(22) Filed: Apr. 9, 2012

(51) Int. Cl.
*E02D 27/42* (2006.01)

(52) U.S. Cl. ..... 52/299; 52/282.4; 52/293.2; 52/295; 52/763

(58) Field of Classification Search ..... 52/282.1, 52/282.4, 283, 284, 285.3, 293.2, 295, 296, 52/299, 600, 604, 606, 745.09, 763
See application file for complete search history.

(56) References Cited

U.S. PATENT DOCUMENTS 1,345,871 A * 7/1920 Nottebohm ..... 52/781.5
1,477,867 A * 12/1923 Dodson ..... 52/223.7
3,547,396 A * 12/1970 Oueilhe, Jr. ..... 249/19
3,593,477 A * 7/1971 Briggs ..... 52/253
3,594,965 A * 7/1971 Saether ..... 52/125.1
3,783,565 A * 1/1974 Hughes ..... 52/127.1
3,971,179 A * 7/1976 Bodocsi et al. ..... 52/223.11
4,001,990 A * 1/1977 Chase et al. ..... 52/167.4
4,175,362 A * 11/1979 Frederick ..... 52/274
4,193,584 A * 3/1980 Wieser ..... 256/19
4,514,949 A * 5/1985 Crespo ..... 52/603
4,612,744 A * 9/1986 Shamash ..... 52/220.1
4,653,239 A * 3/1987 Randa ..... 52/91.3
4,726,567 A * 2/1988 Greenberg ..... 256/19
4,884,378 A * 12/1989 Scheiwiller ..... 52/169.4
5,233,810 A * 8/1993 Jennings ..... 52/745.19
5,360,296 A * 11/1994 Angelette ..... 405/285
5,404,685 A * 4/1995 Collins ..... 52/309.7
5,531,054 A 7/1996 Ramirez
5,623,797 A * 4/1997 Gravier et al. ..... 52/284
5,678,375 A * 10/1997 Juola ..... 52/655.1
5,878,544 A * 3/1999 McKinnon ..... 52/566
5,890,332 A * 4/1999 Skidmore et al. ..... 52/271
6,047,503 A * 4/2000 Kost ..... 52/79.9
6,098,357 A * 8/2000 Franklin et al. ..... 52/223.7
6,158,188 A * 12/2000 Shahnazarian ..... 52/702
6,178,714 B1 * 1/2001 Carney, Jr. ..... 52/564
6,293,066 B1 * 9/2001 Lohrey ..... 52/396.08
6,401,417 B1 * 6/2002 Leblang ..... 52/481.1
6,434,900 B1 8/2002 Masters
6,508,043 B1 1/2003 Bond
6,532,710 B2 3/2003 Terry
6,571,521 B1 * 6/2003 Ameigh ..... 52/295
6,571,526 B2 * 6/2003 Queen ..... 52/677
6,632,048 B2 * 10/2003 Greenberg ..... 405/284
6,735,913 B2 * 5/2004 Sanders et al. ..... 52/284
6,779,314 B1 * 8/2004 Fan ..... 52/309.12
7,086,811 B2 * 8/2006 Lewis ..... 405/284
7,168,218 B2 * 1/2007 Spratlen et al. ..... 52/604

(Continued)

*Primary Examiner* — Brian Glessner
*Assistant Examiner* — Joshua Ihezie
(74) *Attorney, Agent, or Firm* — Dennis W. Beech

(57) ABSTRACT

The modular building structure has reinforced column and wall panel components to form walls of a building. A foundation of concrete may have rods embedded according to a building floor plan. Concrete blocks with hollow cores may be stacked at specified column locations with at least one rod bracket device positioned in a joint and at least one rod extending upwardly through the hollow core. An attachment rod may be inserted in at least one channel of each rod bracket device. A wall panel may be positioned on the foundation to span the space between adjacent columns. Each wall panel may have at least one embedded rod extending through a lower horizontal member to be attached with a fastener. A wall holding bracket may also engage an outside stud member of adjacent wall panels at each column with the wall holding bracket attached to the rod bracket device.

20 Claims, 4 Drawing Sheets

U.S. PATENT DOCUMENTS

| | | | | |
|---|---|---|---|---|
| 7,454,870 | B2 * | 11/2008 | Greenberg et al. | 52/293.2 |
| 7,454,872 | B2 * | 11/2008 | Cutforth | 52/295 |
| 7,461,487 | B2 * | 12/2008 | Greenberg et al. | 52/293.2 |
| 7,497,054 | B2 * | 3/2009 | Takeuchi et al. | 52/167.1 |
| 7,624,550 | B2 * | 12/2009 | Ospina | 52/334 |
| 7,637,076 | B2 * | 12/2009 | Vaughn | 52/838 |
| 7,641,178 | B2 * | 1/2010 | MacDonald et al. | 256/19 |
| 7,774,995 | B1 | 8/2010 | Zidar | |
| 7,802,409 | B2 * | 9/2010 | Stott | 52/295 |
| 7,900,408 | B2 * | 3/2011 | Holland et al. | 52/202 |
| 7,934,345 | B2 * | 5/2011 | Marsh et al. | 52/223.7 |
| 7,946,086 | B2 * | 5/2011 | Hammer et al. | 52/223.5 |
| 7,971,411 | B2 | 7/2011 | Commins | |
| 2002/0134040 | A1 | 9/2002 | Hew | |
| 2002/0194831 | A1 | 12/2002 | Mead | |
| 2004/0020147 | A1 * | 2/2004 | Martella et al. | 52/261 |
| 2004/0261326 | A1 * | 12/2004 | Thomason et al. | 52/79.1 |
| 2006/0201082 | A1 * | 9/2006 | Hammer et al. | 52/223.5 |
| 2007/0186497 | A1 * | 8/2007 | Burkett et al. | 52/259 |
| 2008/0289286 | A1 * | 11/2008 | Letton | 52/741.15 |
| 2009/0064619 | A1 | 3/2009 | Bowerman | |
| 2009/0100786 | A1 * | 4/2009 | Krantz | 52/741.3 |
| 2011/0030299 | A1 | 2/2011 | Raynor | |
| 2011/0154754 | A1 | 6/2011 | Antonic | |

* cited by examiner

STRUCTURALLY REINFORCED MODULAR BUILDINGS

BACKGROUND OF THE INVENTION

This invention relates to building structures that have reinforced column and wall panel modular components that may be assembled and attached to form walls of a building and may be anchored or attached to a foundation and may support an attached roof. The new modular building structure may incorporate rod bracket devices in columns or pilasters to position and hold threaded rods, rebar and the like metal members in columns formed of hollow concrete or masonry blocks stacked on top of each other for wall panels and other components to be attached to the rods to form walls that include doors, windows and other building elements.

Building structures that may be known include wall systems for fences that may be constructed of bricks or wood and may incorporate concrete block columns with rebar and grout for reinforcement. These structures usually do not incorporate reinforcement components for earth quake type forces experienced on such brick structures. Mortarless masonry structures that use regular masonry blocks or bricks connected to each other by a plurality of metal bars and metal fasteners to form a post tension structure may also be known. These structures may not incorporate components in a generally standard construction manner for assembly with wall paneling and ceiling structure.

Other building structure systems that may be known include solid monolithic concrete wall systems that may be used for temporary or permanent buildings. The building components of such structures generally use concrete or masonry blocks or wall panel members to form the building walls. Such structures may address the needs of the marketplace for energy savings and fire protection. However, the use of generally 100% concrete construction on interior and exterior walls and perhaps the ceilings of buildings may be much more complex and expensive than necessary for houses or condominiums for family habitat. Certainly concrete constructed buildings for commercial and industrial buildings may be known in many forms. The use of concrete or masonry structural columns for a building system as in the instant invention designed to reinforce modular wood wall paneling may provide significant manufacturing and assembly savings for family housing construction and also provide disaster resistant houses, for the effects of earthquakes, high winds and other natural events that are known to damage or destroy housing structures.

SUMMARY OF THE INVENTION

The present invention is directed to modular building structures having reinforced column and wall panel components to form walls of a building. A foundation of concrete may have a plurality of rods embedded according to a building floor plan pattern. Concrete blocks with hollow cores may be stacked at specified column locations with at least one rod bracket device positioned in a joint and at least one rod extending upwardly through the hollow core. An attachment rod may be inserted in at least one channel of each rod bracket device in each column. A wall panel may be positioned on the foundation to span the space between adjacent columns and to abut the side of each column. Each wall panel may have at least one embedded rod extending through a lower horizontal member to be attached with a fastener. A wall holding bracket may also engage an outside stud member of each two adjacent wall panels at each column with the outside holding bracket attached to the rod bracket device of the column.

These and other features, aspects and advantages of the present invention will become better understood with reference to the following drawings, description and claims.

DETAILED DESCRIPTION

Figure 1:
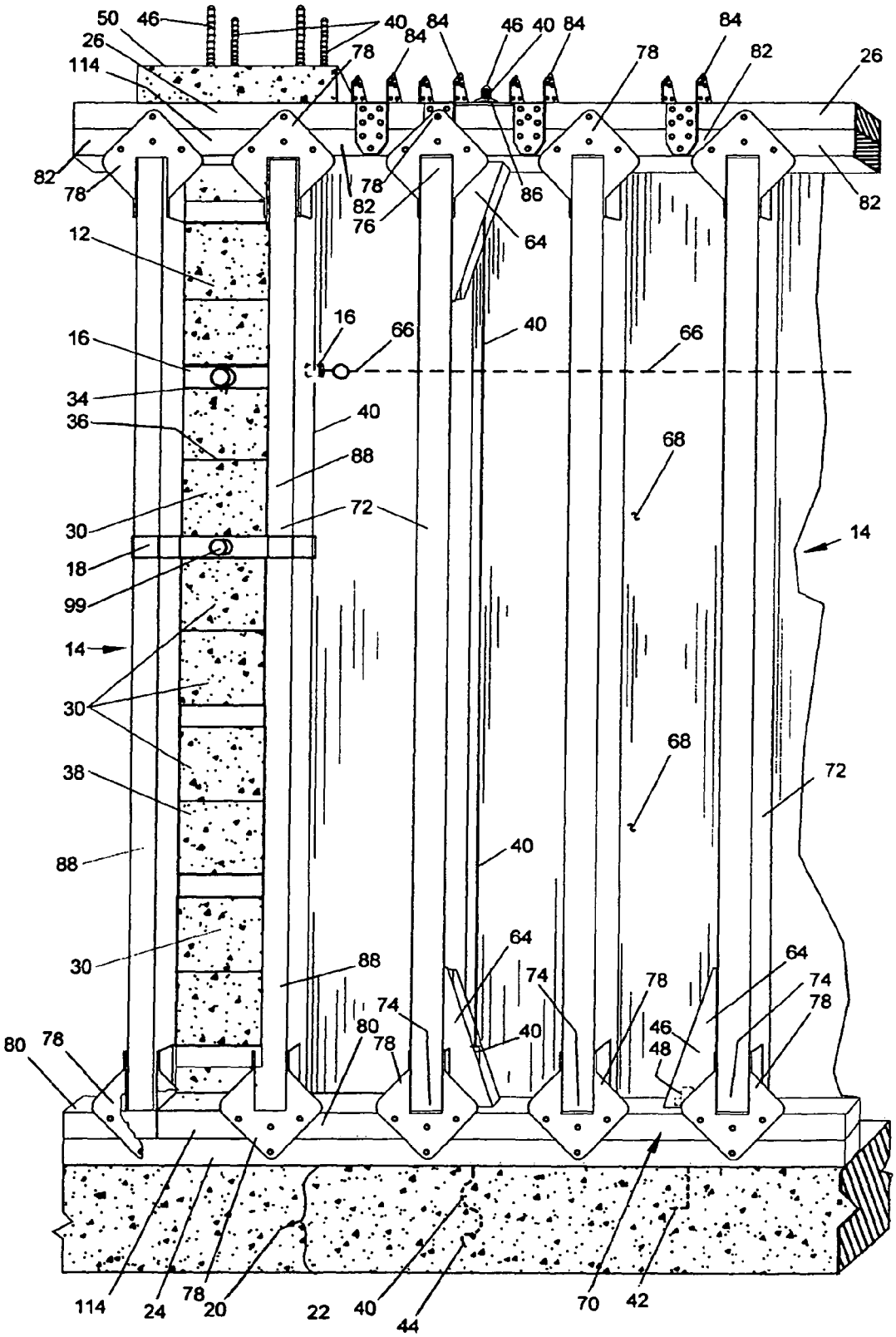
FIG. 1 illustrates a perspective elevation view of a portion of a wall with a wall panel positioned at each side to a column according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 3 and 9, some of the components of a reinforced modular building structure 10 may be a column 12, a wall panel 14 and a rod bracket device 16 for attachment of the wall panel 14 to one or more columns 12. The columns 12 and wall panels 14 may be positioned and attached on a foundation 20 of poured level concrete. There may also be a vertical wall footing 22 of concrete that the lower horizontal member 80 of a wall panel 14 may be positioned and attached. There may be a foundation wood beam 24 that may be chemically treated and positioned on the footing 22 under the horizontal member 80. Rods 40, rebar 42, bolts and the like may have one end embedded in the foundation 20 concrete for use in attachment of various components and members.

Multiple masonry or concrete blocks 30 with hollow cores 32 or central portions may be stacked or assembled on top of each other with the hollow cores 32 forming an elongated vertical cavity through which generally vertical rebar 42 with a lower end 44 embedded in the foundation 20 may extend upwardly to have an upper end 46 extend outwardly above the top surface 50 of columns 12. A common hollow building block size is 12 by 12 inches and 8 inches in height. The concrete blocks 30 may have transverse walls formed in the hollow cores 32.

Multiple rod bracket devices 16 may be positioned in selected joints 34 between the stacked concrete blocks 30 such that the vertical rebar 42 passes through holes 52 in the rod bracket device 16 for structural support. All of the joints 34, 36 may be filled with grout, epoxy or the like and the hollow cores 32 may be filled with concrete that embeds the rebar's 42 for reinforced column 12 structures.

Attachment rods 98 that may have threaded ends 48 or be entirely threaded may be positioned in channels 54 or tubes formed in the structure of the rod bracket device 16. The rod bracket device 16 may have the form of a rectangular outer frame 56 with holes 52 at each corner 58. A channel 54 may be positioned and attached orthogonal to a first two opposed sides 60 of the rod bracket device 16 for attachment rods 98 to be positioned in to project outwardly from the sides 38 of a column 12. If a second attachment rod 98 is to be positioned in the rod bracket device 16 to project outwardly orthogonally to a first attachment rod 98 a second channel 54 may be positioned and attached orthogonal to a second two opposed sides 60 of the rod bracket device 16, as best viewed in FIG. 3. The orthogonal channels 54 may have a large enough diameter for attachment rods 98 to be positioned crossing each other. The rod bracket device 16 has open spaces 62 to allow concrete to pass therethrough when filling a column 12 for structural support. Washers 95 or disks may be positioned on channels 54 for added reinforcement. The rod bracket device 16 may have the rectangular outer frame 56 sized to be positioned interior to the columns 12 for vertical rods 40 to pass through holes 52. The channels 54 may have ends 55 protrude through the selected joints 34.

Multiple wall panels 14 may be frame members 70 that are generally rectangular in shape and have a size of 8 feet by 8 feet and approximately 2 inches wide or 8 feet by 12 feet and approximately 2 inches to 6 inches in width.

The frame members 70 may have multiple studs 72 spaced apart approximately 12 to 18 inches or other desired spacing for structural strength, or to insert a window or door structure in the frame member 70. The studs 72 may be attached at their bottom ends 74 to a lower horizontal member 80 using screws, nails, stud brackets 78 or other suitable fastener and at a top end 76 to a head member 82 using suitable fasteners. The stud brackets 78 used to attach to the head member 82 may be positioned adjacent joist brackets 84 for positioning joists 86 for a ceiling or roof (not shown) for a house. A strap 86 that may be made of metal may be attached between adjacent stud brackets 78 or joist brackets 84 for added reinforcement, for example, for earthquake forces, and for proper installation spacing of brackets 78 for stud 72 positioning. Plywood panels 68 that commonly are available in 4 foot by 8 foot size sheets may be attached to the frame member 70 to complete wall panels 14. Other panel 68 material may also be used. Strapping material may be used to strengthen abutting panels for additional reinforcement.

In construction of a wall on site, once the foundation 20 and columns 12 are finished with the columns 12 positioned according to a building floor plan 28 and spaced apart for the size of wall panel 14 to be used, for example, approximately 7½ feet for 8 foot panels, the wall panels 14 can be positioned on the foundation wood beams 24 and attached by fasteners and brackets that may be a portion of the stud brackets 78. The rods 40 or rebar 42 that may be embedded at one end in the foundation 20 and may have opposite threaded end 48 to be used to further attach the wall panels 14. Joint brackets 64 may be used in the frame member 70 to further strengthen the attachment.

The outside frame studs 88 that abut the columns 12 may be spaced apart by a spacer block 114 of wood and be attached to the columns 12 by fastening multiple wall holding brackets 18 to rod bracket devices 16 embedded in the columns 12. The wall holding brackets 18 may have a generally U-shape form with stud flanges 92 on each arm 90. The stud flanges 92 may be positioned over the outside frame studs 88 of adjacent wall panels 14 and the wall holding bracket 18 having a hole 96 in the cross arm 94 is positioned on a threaded attachment rod 98 protruding from a column 12 to be secured by a nut 99. As adjacent wall panels 14 are installed, a wall header board 26 may be attached to frame head members 82 to span across at least adjacent wall panels 14 prior to attaching stud brackets 78 and ceiling or roof joists.

Figure 5:
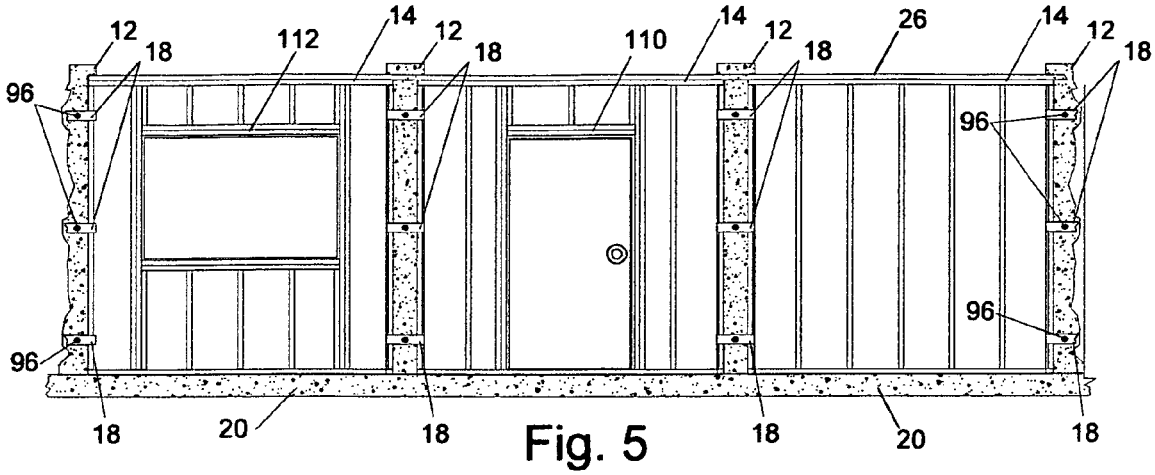
FIG. 5 illustrates an elevation view of an arrangement of 8×8 foot wall panels according to an embodiment of the invention.
Figure 6:
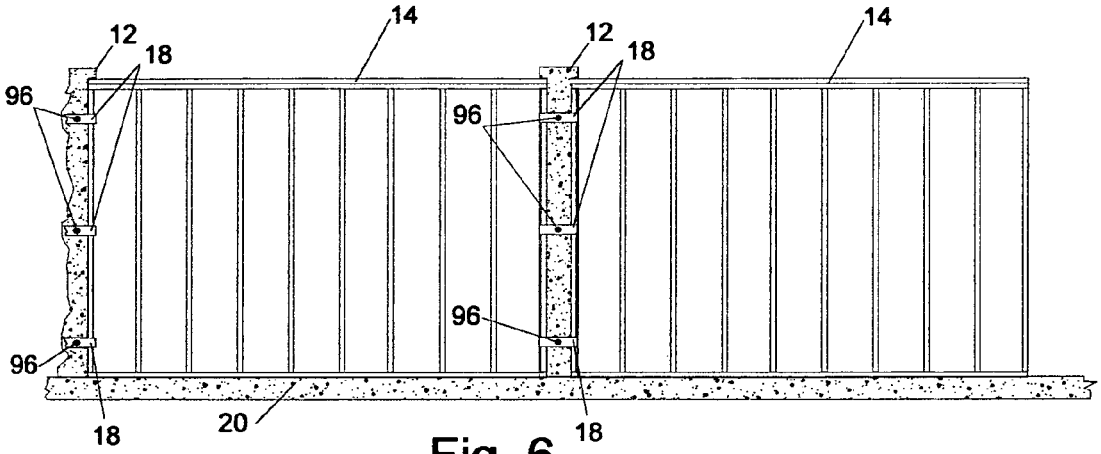
FIG. 6 illustrates an elevation view of an arrangement of 8×12 foot wall panels according to an embodiment of the invention.
Figure 7:
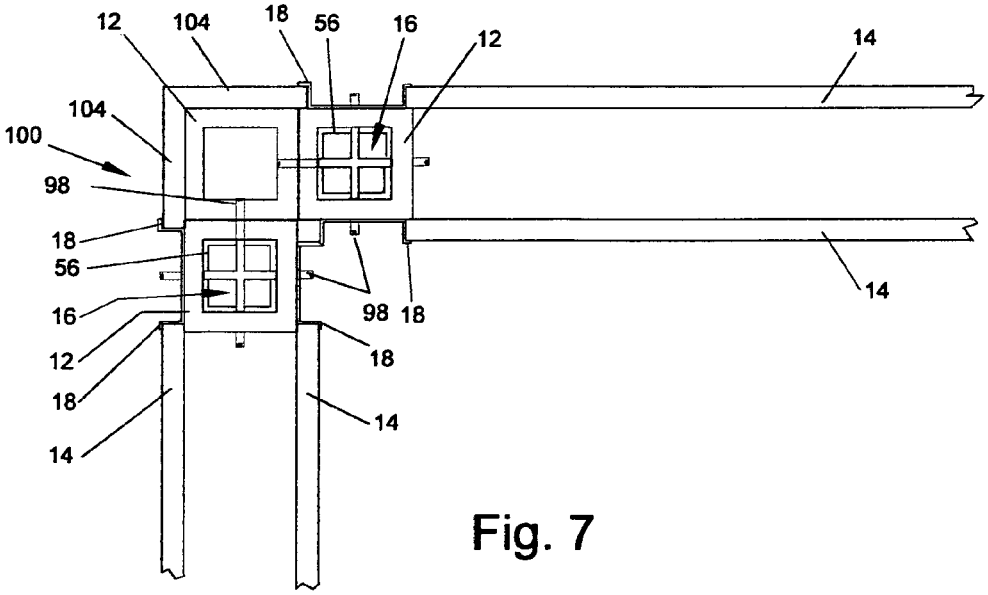
FIG. 7 illustrates a top plan schematic view of a building corner according to an embodiment of the invention.

Referring to FIGS. 1 through 6, various wall panel 14 configurations are illustrated for use in constructing walls for the modular reinforced building structure 10. FIGS. 5 and 6 illustrate 8×8 foot wall panels 14 that are basic, with a door frame 110 and with a window frame 112 as well as basic 8×12 foot panels attached adjacently. For added reinforcement an elongated tension device 66, such as cables or springs, may be attached between adjacent columns 12 by attachment of opposed ends to protruding rods 40 of columns 12, as best viewed in FIG. 2. The panels 68 may serve as the outside surface of a house. The panels 68 may allow other building components to be installed such as structure necessary for a stucco exterior surface. Wall panels 14 can also be attached to the exterior sides 38 of the columns 12 to construct a double panel wall as illustrated in FIG. 7. This pairing of opposed panels 14 may provide additional insulation for climate control. The rods 40 or rebar 42 that are embedded in the foundation 20 may be elongated to extend upwardly to transition through both a lower horizontal member 80 and a head member 82 of a wall panel 14 for added reinforcement to the building structure 10 by attaching an upper end 46 above the wall header board 26, as best viewed in FIG. 1.

The type of structure described herein may allow for manufacture of wall panels 14 made of wood or other materials to be performed at a factory location rather than at a particular building site. The foundation 20 and columns 12 may first be constructed on site according to a house floor plan. The wall panels 14 may be shipped from the factory to various building sites to then be positioned on the foundation 20 and attached to the columns 12.

Referring to FIG. 7, a corner 10 of a house may have two columns 12 positioned with one corner 102 of each column abutting to support wall panels 14 extending away from the corners 102 in generally an orthogonal configuration. An outside column surface of each of the two columns 12 is at right angles relative to each other and a third column 12 is abutted against the column surfaces. Two outside wall members 104 may be attached to the exterior sides 38 of all three columns 12 to mate with exterior wall panels 14 as best viewed in FIG. 7. The cavity 106 may be filled with concrete for added reinforcement to the corner 100. There may be one or more roof support columns 108 positioned interior to the outer walls of a building for roof joist structural support, as best viewed in FIG. 8. The roof support column 108 may be approximately 5 feet or higher and elongated tension devices 66 may be attached between columns 12 and 108.

Figure 2:
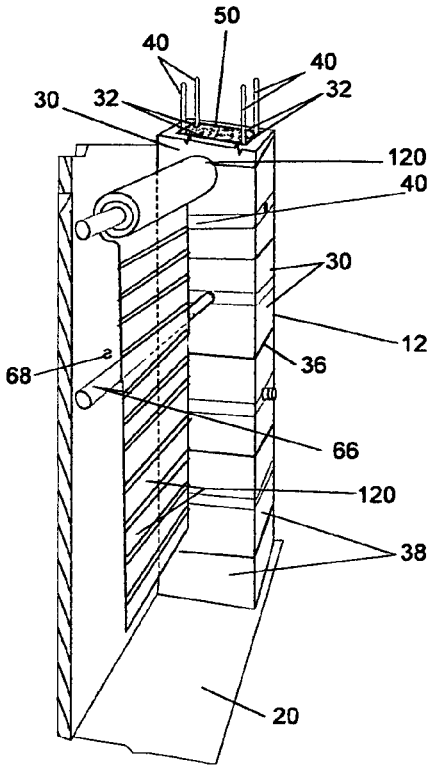
FIG. 2 illustrates a perspective elevation view of the opposite side of the wall portion illustrated in FIG. 1 according to an embodiment of the invention.
Figure 3:
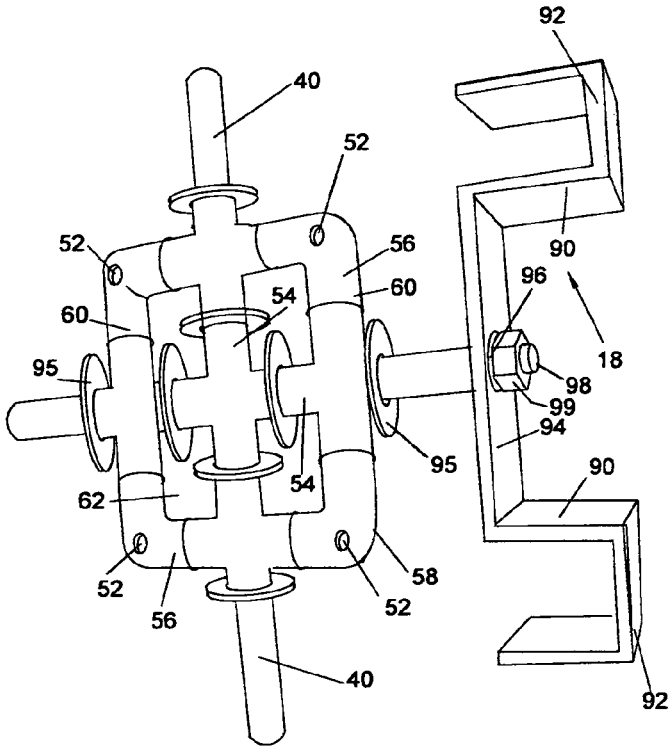
FIG. 3 illustrates a perspective view of a rod bracket device with a wall attachment bracket attached to a threaded rod according to an embodiment of the invention.
Figure 4:
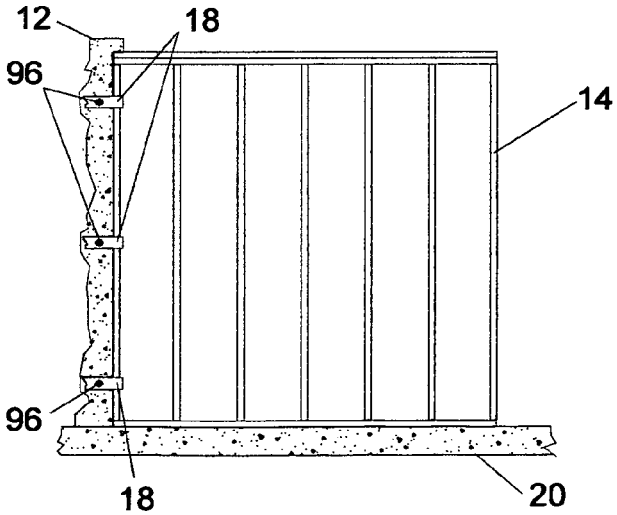
FIG. 4 illustrates an elevation view of a single 8×8 foot wall panel according to an embodiment of the invention.
Figure 9:
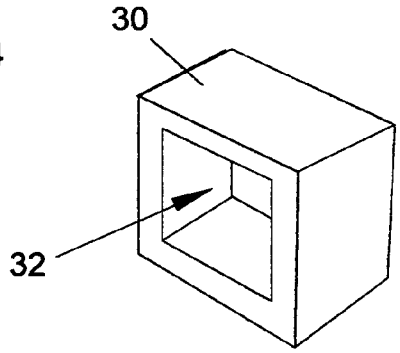
FIG. 9 illustrates a perspective view of a concrete block according to an embodiment of the invention.
Figure 8:
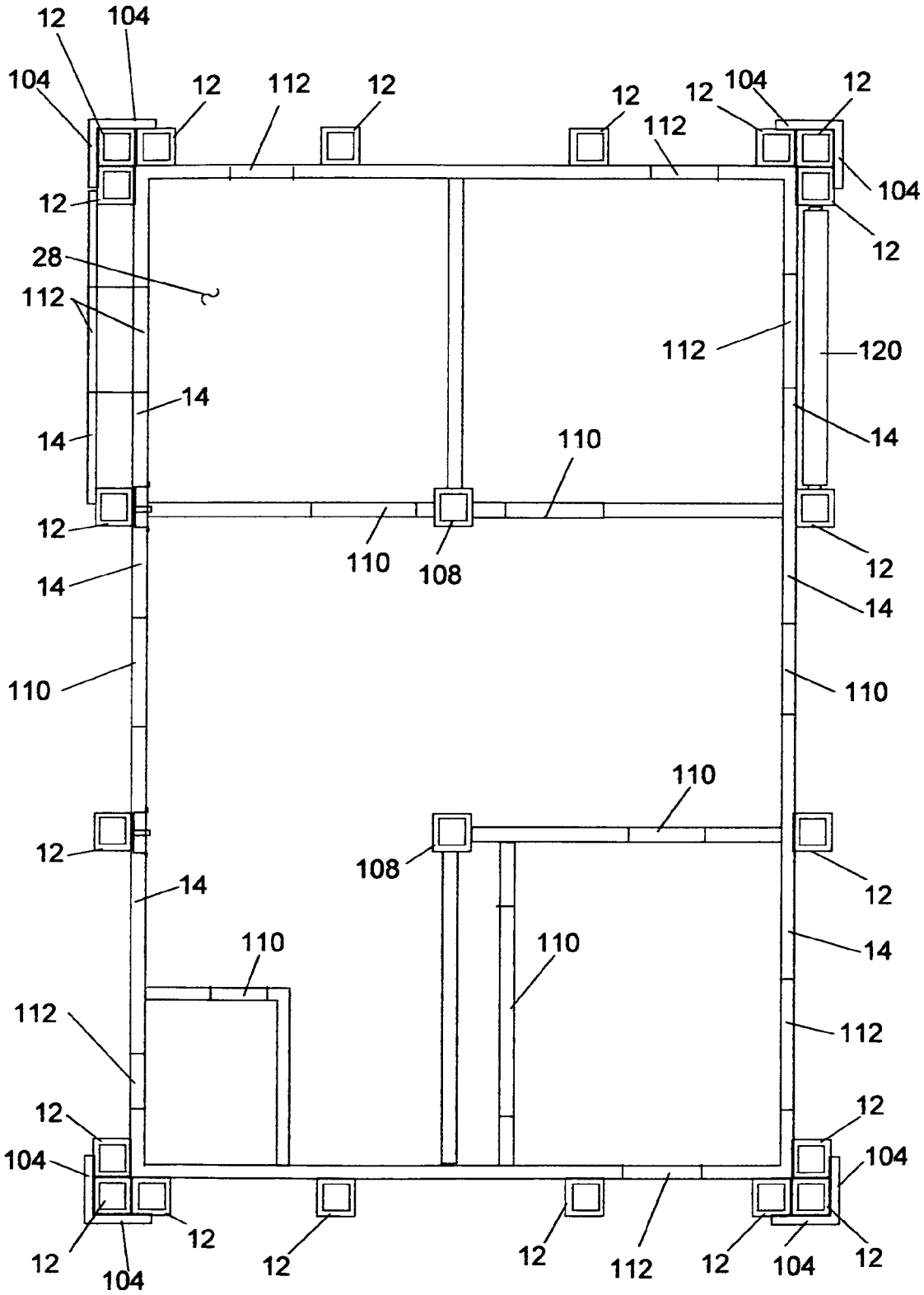
FIG. 8 illustrates a schematic view of a floor plan for building columns and wall panels according to an embodiment of the invention.

Referring to FIGS. 2 and 8, for added security from intruders as well as from environmental effects, siding covers 120 or panels that are deployable and retractable similar to roll up doors can be attached to adjacent columns 12. When the covers 120 are deployed they provide a secondary security panel that may protect windows and doors from breakage for example in the event of a tornado or hurricane. The siding covers 120 may be formed of a metal material.

While the invention has been particularly shown and described with respect to the illustrated embodiments thereof, it will be understood by those skilled in the art that the foregoing and other changes in form and details may be made therein without departing from the spirit and scope of the invention.

I claim:

1. A building system for a modular building structure construction on a foundation of poured concrete comprising:

a foundation of concrete with a plurality of rods disposed and embedded at a lower end in said foundation in a building floor plan pattern to engage a plurality of columns and a plurality of wall panels;

a plurality of concrete blocks with a hollow core stacked on top of each other to a specified height above said foundation with at least one rod bracket device disposed in a joint and with at least one of said rods extending upwardly through said hollow core to form a plurality of columns on said foundation;

an attachment rod is inserted in at least one channel of said rod bracket device in each of said columns;

a plurality of wall panels are disposed on said foundation abutting a side of each of said columns for each of said wall panels to span the space between adjacent columns; and each of said wall panels has at least one of said rods extending through a lower horizontal member and attached with a fastener, and a wall holding bracket engaged with an outside stud member of two adjacent wall panels at one of said columns and attached to said attachment rod of said rod bracket device.

2. The building system as in claim 1 wherein said wall panels comprising:

a frame member that has a generally rectangular shape of approximately 8 feet long by 8 feet high with a width of approximately 1 inch to 6 inches;

a plurality of studs may be spaced apart approximately 12 inches to 18 inches and attached at a bottom end to a lower horizontal member and attached at a top end to a head member; and a plurality of plywood panels are attached to said frame member.

3. The building system as in claim 2 wherein said frame member has a window frame disposed therein.

4. The building system as in claim 2 wherein said frame member has a door frame disposed therein.

5. The building system as in claim 2 wherein said plurality of studs at said bottom end and said top end are attached with a stud bracket and a plurality of screws.

6. The building system as in claim 2 wherein each of said stud brackets has a metal bracket portion for positioning and attaching a joist and a strap is attached between adjacent studs to aid in spacing each of said studs.

7. The building system as in claim 2 wherein said frame member has an elongated length of 12 feet for a generally rectangular shape of 12 feet by 8 feet.

8. The building system as in claim 1 wherein there is a vertical wall footing attached to said foundation disposed to be between said foundation and said plurality of wall panels.

9. The building system as in claim 8 wherein a foundation wood beam is disposed on said vertical wall footing.

10. The building system as in claim 1 wherein said rods extend above a top surface of said columns, concrete is disposed in said hollow core, and grout is disposed in said joints.

11. The building system as in claim 1 wherein said rod bracket device comprising:

a rectangular outer frame having holes at each corner; and a first channel is attached orthogonal to a first two opposed sides of said rectangular outer frame.

12. The building system as in claim 11 wherein a second channel is attached orthogonal to said first channel and to a second two opposed sides of said rectangular outer frame.

13. The building system as in claim 12 wherein at least one attachment rod is inserted in one of said first channel and said second channel.

14. The building system as in claim 1 wherein said wall holding bracket comprising:

a generally U-shape bracket with a cross arm having an aperture centrally disposed therein; and a pair of arms extending orthogonally at each end of said cross arm and a stud angle flange formed at the end of each arm.

15. The building system as in claim 1 wherein an elongated tension device is attached between adjacent columns by attachment to said rod bracket device.

16. The building system as in claim 1 wherein selected rods are extended to transition through said lower horizontal member and said head member through joint brackets disposed at stud joints in said frame member and said selected rods are attached above a wall header board attached to said head members.

17. The building system as in claim 1 wherein said plurality of wall panels further comprise disposed and attached pairs of wall panels to abut opposed sides of said columns.

18. The building system as in claim 1 wherein:

a corner of said building has two of said columns positioned with a corner of each column abutting to support one of said wall panels extending away in a generally orthogonal direction; and an outside column surface of each column has a wall member attached to intersect orthogonally to form a hollow at said corner through which said rods extend upwardly and said hollow has concrete disposed therein.

19. The building system as in claim 1 wherein a roof support column is positioned on said foundation.

20. The building system as in claim 1 wherein a plurality of siding panels are disposed and attached between adjacent columns.

* * * * *